US008833124B2

(12) United States Patent
Cripsey et al.

(10) Patent No.: US 8,833,124 B2
(45) Date of Patent: Sep. 16, 2014

(54) FLOW FORMED SPLINE AND DESIGN SUITABLE FOR BURR FREE MACHINING

(71) Applicant: Metal Forming & Coining Corporation, Maumee, OH (US)

(72) Inventors: Timothy J. Cripsey, Rochester Hills, MI (US); Ron Taranto, Rochester Hills, MI (US); Ben R. Vasa, Lapeer, MI (US)

(73) Assignee: Metal Forming & Coining Corporation, Maumee, OH (US)

( * ) Notice: Subject to any disclaimer, the term of this patent is extended or adjusted under 35 U.S.C. 154(b) by 0 days.

(21) Appl. No.: 13/891,902

(22) Filed: May 10, 2013

(65) Prior Publication Data

US 2013/0247636 A1 Sep. 26, 2013

Related U.S. Application Data

(62) Division of application No. 12/065,507, filed as application No. PCT/US2006/034187 on Aug. 31, 2006, now Pat. No. 8,459,080.

(60) Provisional application No. 60/712,939, filed on Aug. 31, 2005.

(51) Int. Cl.

| | |
|---|---|
| ***B21D 22/00*** | (2006.01) |
| ***B21D 22/18*** | (2006.01) |
| ***B21J 5/12*** | (2006.01) |

(52) U.S. Cl.
CPC .. *B21D 22/18* (2013.01); *B21J 5/12* (2013.01)
USPC ..... 72/84; 72/82

(58) Field of Classification Search
USPC ..... 72/82–85, 102–108, 110; 29/893.3, 29/893.35, 893.32, 893.36
See application file for complete search history.

(56) References Cited

U.S. PATENT DOCUMENTS

| | | | | |
|---|---|---|---|---|
| 2,960,114 | A * | 11/1960 | Hinde | 29/890.049 |
| 4,807,351 | A * | 2/1989 | Berg et al. | 29/432 |
| 5,509,287 | A * | 4/1996 | Garden | 72/88 |
| 5,584,202 | A | 12/1996 | Kanamaru et al. | |
| 5,934,126 | A * | 8/1999 | Maruki et al. | 72/85 |
| 6,508,094 | B1 * | 1/2003 | Gotou et al. | 72/85 |
| 6,530,253 | B1 * | 3/2003 | Gotou et al. | 72/85 |
| 6,694,791 | B1 | 2/2004 | Johnson et al. | |
| 8,459,080 | B2 | 6/2013 | Cripsey et al. | |
| 2004/0074327 | A1 * | 4/2004 | Huber et al. | 74/431 |

* cited by examiner

*Primary Examiner* — Shelley Self
*Assistant Examiner* — Pradeep C Battula
(74) *Attorney, Agent, or Firm* — Fraser Clemens Martin & Miller LLC; J. Douglas Miller

(57) ABSTRACT

A method and tool for producing a flow formed part are disclosed, wherein the tool has an annular array of spline forming recesses for producing a flow formed part having splines and machining and production costs are minimized and efficiency is maximized.

17 Claims, 5 Drawing Sheets

FLOW FORMED SPLINE AND DESIGN SUITABLE FOR BURR FREE MACHINING

CROSS-REFERENCE TO RELATED APPLICATION

This application is a divisional of U.S. patent application Ser. No. 12/065,507, filed on Apr. 17, 2009, which claims the benefit of U.S. Provisional Patent Application Ser. No. 60/712,939, filed Aug. 31, 2005. The entire disclosures of the above applications are hereby incorporated herein by reference.

FIELD OF THE INVENTION

The invention relates to a tool, and more particularly to a tool having an annular array of spline forming recesses for producing a flow formed part, and a method of using same.

BACKGROUND OF THE INVENTION

Flow forming is a process used to produce a formed metal part. Flow forming is the use of metal forming lathes to extrude a blank or a preform prepared from a desired material into the formed metal part. Flow forming provides the features traditionally provided by a stamping process while providing the additional benefits of improved dimensional capabilities, work hardening up to three-times the desired material properties, and the ability to use the part after formation with limited or no additional machining required.

Typical flow formed parts include gears, clutch drums, and other similar parts that may include splines. The formation of parts having closed ended splines has presented a problem wherein a tool used to form the part and a subsequent process used to trim or machine the part results in undesirable burrs and other surface flaws on the formed part. Therefore, the cost of production and the overall efficiency of the process utilizing the part are adversely affected.

It would be desirable to produce a tool for forming a splined part, which minimizes machining and production costs for making splined parts and maximizes efficiency.

SUMMARY OF THE INVENTION

Congruous and concordant with the present invention, a tool for producing a splined part which minimizes machining and production costs and maximizes efficiency, has been discovered.

In one embodiment, the tool for producing a flow formed part comprises a main body having a first end and a second end, the first end adapted to abut a blank prepared from a flowable material; and an annular array of spline forming recesses formed intermediate the first end and the second end of said main body, said spline forming recesses including an outlet at one end thereof, the outlet facilitating the flow of a portion of the flowable material therethrough during a flow forming process thereby producing a protuberant portion.

In one embodiment, an apparatus for producing a flow formed part comprises a die having a main body including a first end, a second end, and an annular array of recesses intermediate the first end and the second end, each having an outlet formed at an end thereof, the first end adapted to abut a blank formed of a flowable material, wherein the outlets facilitate the flow of a portion of the flowable material therethrough during a flow forming process; and a pressure plate adapted to receive a portion of the first end of said die, wherein said die is axially fixed to said pressure plate and said die and the blank are adapted to axially rotate with said pressure plate.

In one embodiment, the method of producing the flow formed part comprises the steps of providing a blank formed of a flowable material; providing a tool having a first end and a second end, the first end adapted to abut the blank, the tool having an annular array of recesses formed intermediate the first end and the second end, the recesses including an outlet formed at one end thereof; positioning the first end of the tool adjacent the blank; applying pressure to the blank to cause the material of the blank to flow into the recesses of the tool to form a part having a plurality of splines, at least a portion of the material flowing through the outlet of the recesses forming a protuberant portion on the splines of the part; and removing the protuberant portion from the splines of the part.

BRIEF DESCRIPTION OF THE DRAWINGS

The above object and advantages of the invention will become readily apparent to those skilled in the art from reading the attendant description of an embodiment of the invention when considered in the light of the attached drawings, in which.

DETAILED DESCRIPTION OF A PREFERRED EMBODIMENT OF THE INVENTION

The following detailed description and appended drawings describe and illustrate exemplary embodiments of the invention. The description and drawings serve to enable one skilled in the art to make and use the invention, and are not intended to limit the scope of the invention in any manner. In respect of the methods disclosed and illustrated, the steps presented are exemplary in nature, and thus, the order of the steps is not necessary or critical.

Figure 1:
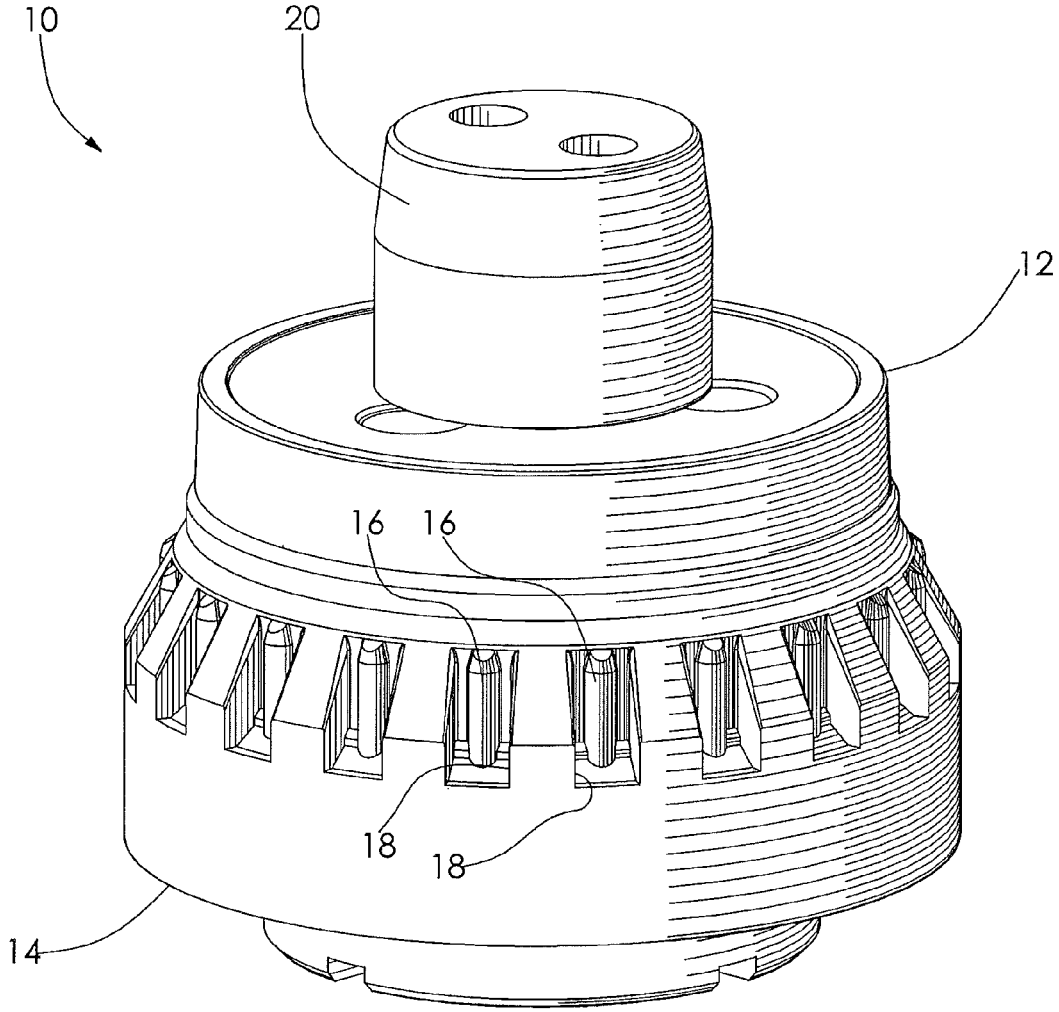
Fig. 1 (Prior Art)
FIG. 1 is a perspective view of a tool used to produce a splined part according to the prior art.
Figure 4:
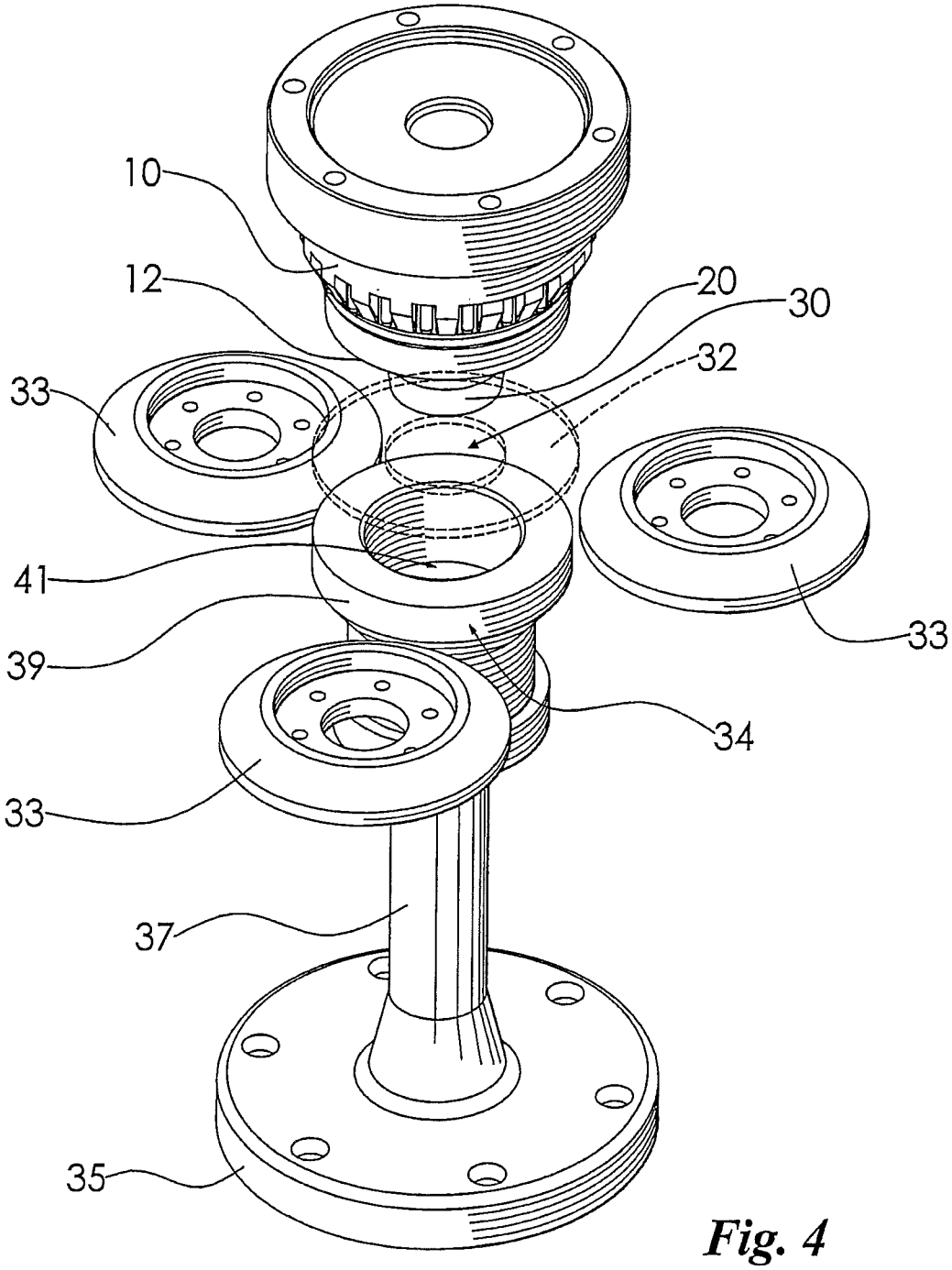
Fig. 4 (Prior Art)
FIG. 4 is a perspective view of a flow forming apparatus including the tool of FIG. 1, a blank, a plurality of rollers, and a pressure plate according to the prior art.

FIG. 1 shows a tool 10 of the prior art. The tool 10 can be any conventional tool such as a tool for producing a clutch drum, for example. The tool 10 includes a first end 12 and a second end 14. The first end 12 of the tool 10 includes a stem 20 extending therefrom adapted to be inserted into an aperture 30 of a blank 32 (shown in FIG. 4) prepared from a desired material. It is understood that the stem 20 may be an integrally formed portion of the tool 10 or separately formed and attached to the tool 10, if desired. Any conventional deformable material can be used to prepare the blank 32 such as steel, a steel alloy, titanium, or aluminum, for example. FIG. 4 shows the blank 32 as an annular ring, however it is understood that the blank 32 may have any shape such as round, for example, as desired. An exterior of the tool 10 has an annular array of spline forming recesses 16 formed therein intermediate the first end 12 and the second end 14. The spline forming recesses 16 have sharp corners 18 or fillets.

Figure 2:
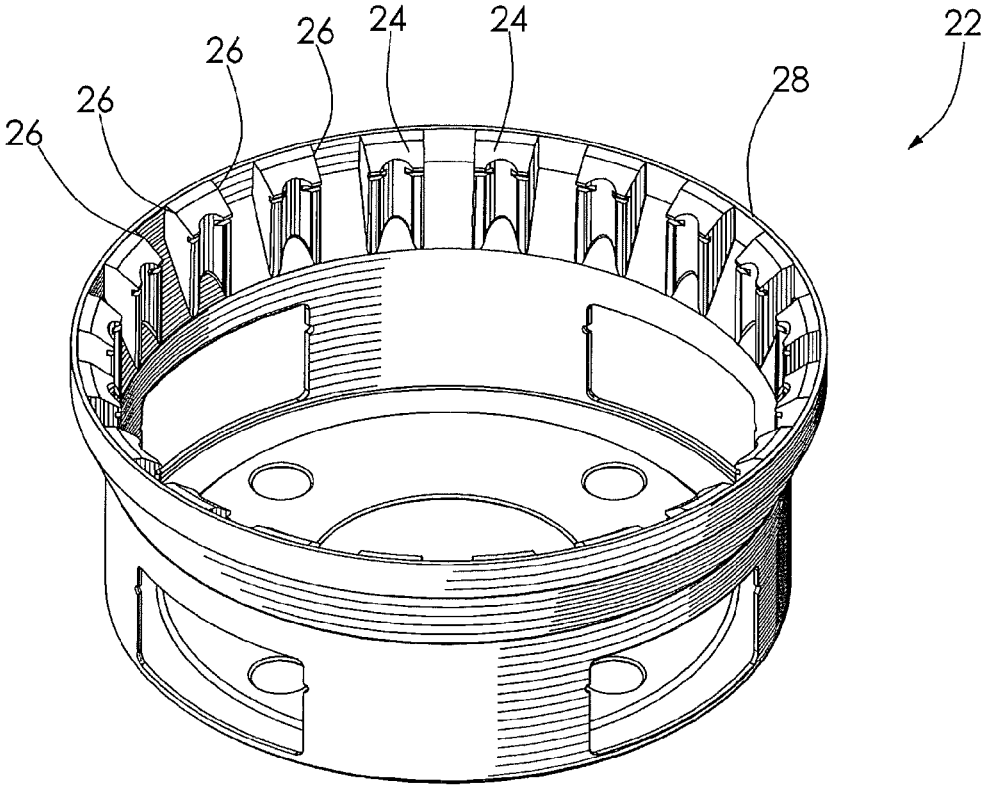
Fig. 2 (Prior Art)
FIG. 2 is a perspective view of a splined part produced using the tool shown in FIG. 1 according to the prior art.
Figure 3:
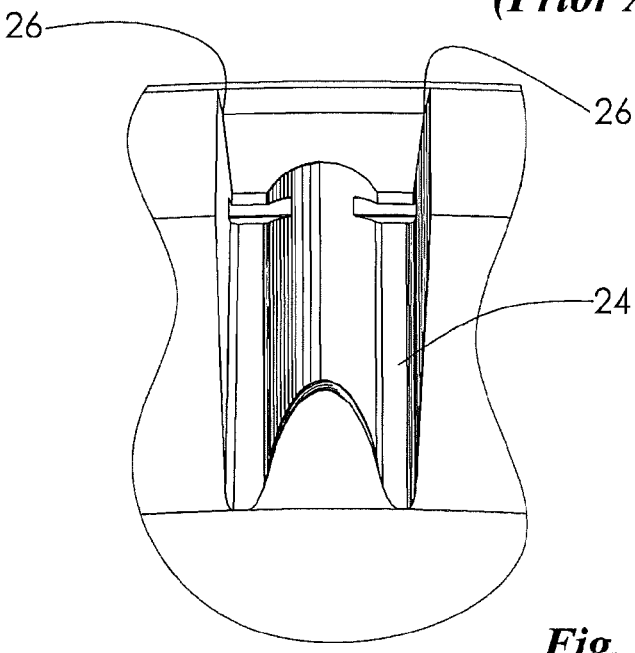
Fig. 3 (Prior Art)
FIG. 3 is an enlarged fragmentary view of a spline of the part illustrated in FIG. 2 according to the prior art.

The flow formed part 22 of the prior art is formed from the blank 32 using the tool 10 shown in FIG. 2. The flow formed part 22 of the prior art includes an annular array of splines 24 having sharp corners 26 or fillets formed at an outer edge 28 of the flow formed part 22. Any conventional deformable material can be used to form the flow formed part 22 such as steel, a steel alloy, titanium, copper, for example. It is understood that the flow formed part 22 may be any part adapted to transfer rotational motion from a first rotating member to a second rotating member, such as a gear, for example.

The process to form the flow formed part 22 is a multi-step process. First, the blank 32 is formed by punching, cutting, or shearing the blank 32 from a stock of material to a predetermined shape. The blank 32 is then disposed in a flow forming apparatus 40. The apparatus includes the tool 10, the blank 32, a plurality of rollers 33, and a pressure plate 34. The tool 10 is a male die portion to the female formed part 22. It is understood that the tool 10 may be a male die, a female die, or a die with both male and female die portions. The pressure plate 34 includes a bearing plate 35, a stem 37 slidably disposed through an aperture (not shown) in the bearing plate 35, an annular shoulder 37 having a cavity 41 adapted to receive at least a portion of the stem 20 of the tool 10, and a hydraulic cylinder (not shown) adapted to apply a force on the stem 37 to cause it to slidably reposition. It is understood that the hydraulic cylinder may be any means of providing a force to slidably position the stem 37 of the pressure plate 34. The blank 32 is disposed on the stem 20 of the tool 10 with the stem 20 positioned through the aperture 30 of the blank 32. The stem 20 of the tool 10 and pressure plate 34 are slidably positioned such that the stem 20 of the tool 10 is received by the cavity 41 formed in the annular shoulder 39. The tool 10 and pressure plate 34 are then clamped together such that the blank 32 is disposed between the first end 12 of the tool 10 and the annular shoulder 39 of the pressure plate 34. The tool 10, the blank 32, and the stem 37 are then caused to axially rotate relative to the bearing plate 35 while the hydraulic cylinder applies a constant pressure on the stem 37 to maintain a position of the pressure plate 34 and tool 10 during a flow forming operation. Next, the rollers 33 are caused to apply pressure to the blank 32 to deform the blank 32 and cause the blank 32 to flow into the spline forming recesses 16 formed in the tool 10. As the pressure on the blank 32 caused by the rollers 33 increases, the temperature of the blank 32 increases and the blank 32 becomes more malleable to facilitate the flow of the material that forms the blank 32 into the spline forming recesses 16 of the tool 10. The pressure applied to the blank 32 may vary depending upon the size of the splines 24 being formed, a thickness of the blank 32 used to form the flow formed part 22, and properties of equipment used to form the flow formed part 22. Additionally, no outlet is provided on the tool 10 to permit relief of excess material from the blank 32 flowing therethrough. Once the material has been caused to fill the spline forming recesses 16, the tool 10 is removed from the flow formed part 22 resulting in a part having an annular array of splines 24 formed thereon, as illustrated in FIG. 2.

Figure 5:
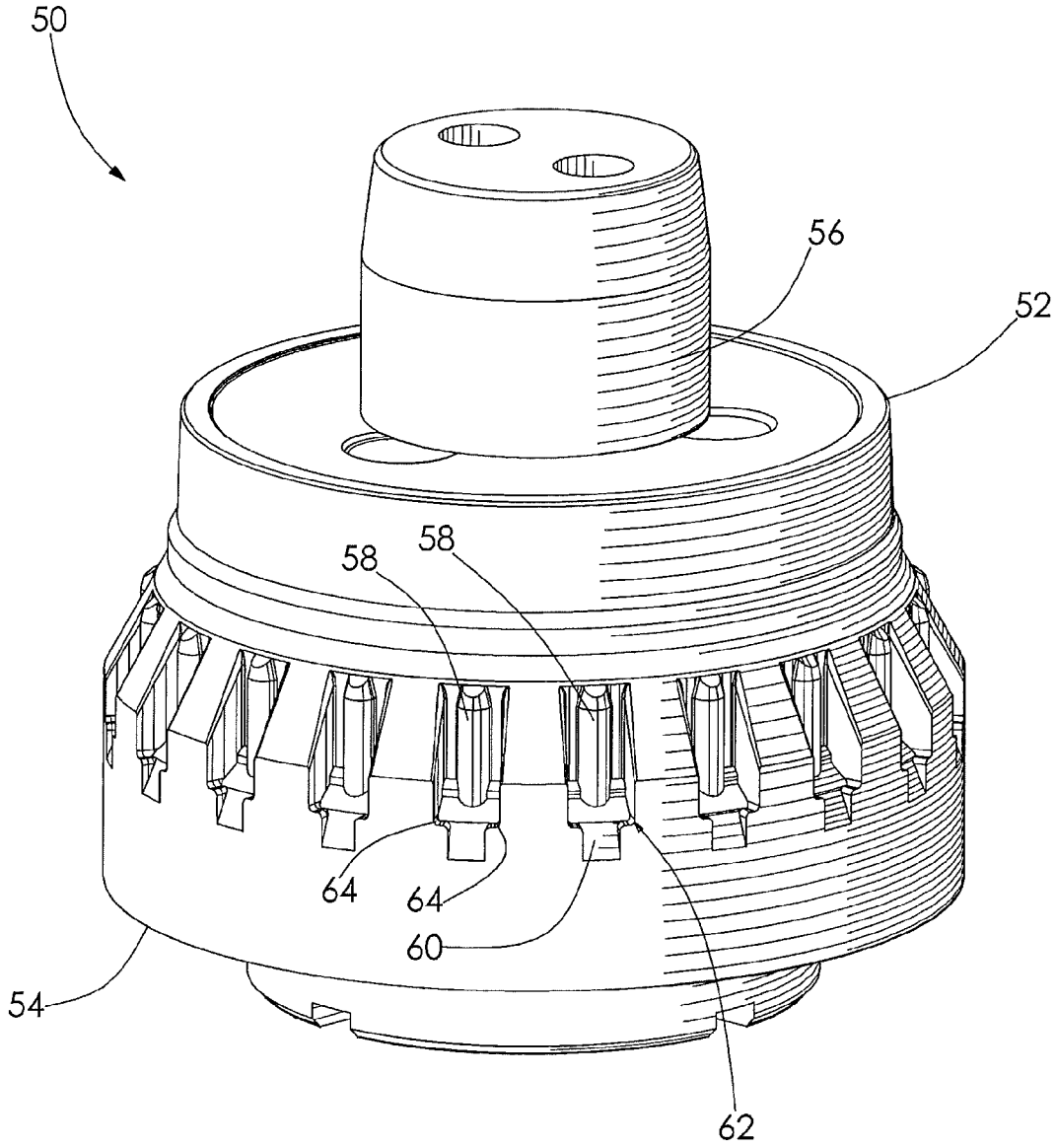
FIG. 5 is a perspective view of a tool according to an embodiment of the invention.
Figure 6:
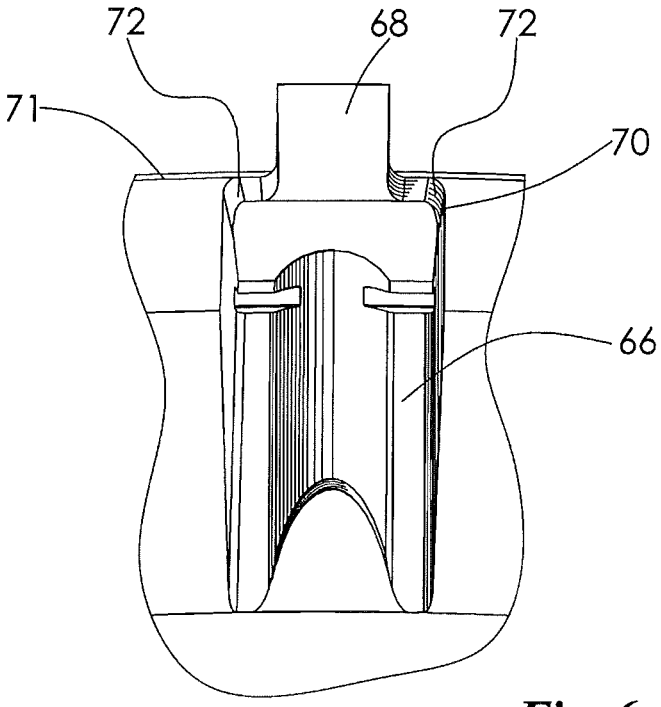
FIG. 6 is an enlarged fragmentary view of a spline produced with the tool illustrated in FIG. 5 and prior to a machining step to remove flowed material.

FIG. 5 shows a tool 50 according to an embodiment of the invention. The tool 50 can be any conventional tool such as a tool for making a clutch drum, a drive shell, a slip spline, or other tool having splines, for example. The tool 50 includes a first end 52 and a second end 54. Similar to the tool 10 shown in FIG. 1, the first end 52 of the tool 50 includes a stem 56 projecting therefrom adapted to be inserted into an aperture of a blank (not shown) prepared from a desired material. It is understood that the stem 56 may be an integrally formed portion of the tool 50 or separately formed and attached to the tool 50, if desired. Any conventional material may be used to form the blank such as steel, a steel alloy, or aluminum, for example. Similar to the blank 32 shown in FIG. 4, the blank used in the present invention may be an annular ring or may have any shape such as round, for example, as desired. An exterior of the tool 50 has an annular array of spline forming recesses 58 formed therein intermediate the first end 52 and the second end 54. The spline forming recesses 58 include an outlet 60 formed at a first end 62 thereof. A rounded corner 64 is formed on each side of the outlet 60. In the embodiment shown in FIG. 5, the outlet 60 has a decreasing pitch to form a wedge shaped protuberant portion 68 on the part to be formed, as illustrated in FIG. 6. However, it is understood that the outlets 60 may form any shape with any pitch which is desired on the part to be produced such as triangular and rectangular, for example.

Similar to the flow formed part 22 of the prior art as particularly illustrated in FIG. 2, the part formed using the tool 50 includes an annular array of splines 66. As shown in FIG. 6 the splines 66 have rounded corners 72 formed at an outer edge 71 of the part. Any conventional material can be used to form the part such as steel, a steel alloy, or aluminum, for example. In the embodiment shown in FIG. 6, the part may be a gear or any other part adapted to transfer rotational motion from a first rotating member to a second rotating member.

The process to form the part is a multi-step process. First, the blank is formed by punching, cutting, or shearing the blank from a stock of material to a predetermined shape. The blank is then disposed in a flow forming apparatus (not shown) that includes the tool 50, the blank, a plurality of rollers (not shown), and a pressure plate (not shown) similar to the apparatus 40 illustrated in FIG. 4. The pressure plate includes a bearing plate (not shown), a stem (not shown) slidably disposed through the bearing plate (not shown), an annular shoulder (not shown) having a cavity (not shown) adapted to receive at least a portion of the stem 56 of the tool 50, and a hydraulic cylinder (not shown) adapted to apply a force on the stem to cause it to slidably reposition. It is understood that the hydraulic cylinder may be any means of providing a force to slidably position the stem of the pressure plate. The blank is then disposed on the stem 56 of the tool 50 with the stem 56 positioned through the aperture of the blank. The stem 56 of the tool 50 and pressure plate are slidably positioned such that the stem 56 of the tool 10 is received by the cavity formed in the annular shoulder. The tool 50 and pressure plate are then clamped together such that the blank is disposed between the first end 52 of the tool 50 and the annular shoulder of the pressure plate. The tool 50, blank, and stem of the pressure plate are then caused to axially rotate relative to the bearing plate while the hydraulic cylinder applies a constant pressure on the stem of the pressure plate to maintain an axial position of the pressure plate and tool 50 during a flow forming operation. Next, the rollers are caused to apply pressure to the blank to deform the blank and cause the blank to flow into the spline forming recesses 58 formed in the tool 50. As the pressure on the blank caused by the rollers increases, the temperature of the blank increases and the blank becomes more malleable to facilitate the flow of the material that forms the blank into the spline forming recesses 58 of the tool 50. Excess material caused to flow into the spline forming recesses 58 is permitted to escape the spline forming recesses 58 through the outlets 60. The rounded corners 64 facilitate the flow of material and direct the material towards the outlets 60, and militate against the formation of burrs or other surface defects on the produced part. The pressure applied to the blank varies depending upon the size of the splines 66 being formed, a thickness of the blank used to form the part, and properties of the equipment used to form the part.

Figure 7:
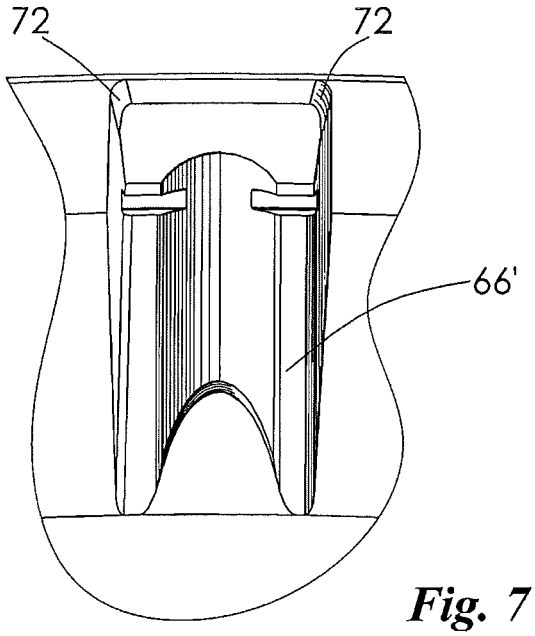
FIG. 7 is an enlarged fragmentary view of the spline illustrated in FIG. 6 and after the machining step to remove flowed material.

Once the material has been caused to fill the spline forming recesses 58, the tool 50 is separated from the part resulting in a part having an annular array of splines 66, as illustrated in FIG. 6, formed thereon. A protuberant portion 68 extends outwardly from a first end 70 of each of the splines 66. A rounded edge 72 is formed on each side of the protuberant portion 68. The protuberant portion 68 extending from each of the splines 66 is removed by any conventional machining process to result in the spline 66' illustrated in FIG. 7. The rounded edges 72 remain on the spline 66' and militate against the formation of burrs or other surface defects on the splines 66' during use of the part.

A benefit of the tool 50 according to the present invention is the formation of splined parts having rounded edges 58 such that burrs produced during the subsequent machining required to produce the finished part are minimized or substantially eliminated. Additionally, because the tool 50 provides an outlet 60 that facilitates a flow of excess material from the spline forming recesses 58, pressure caused by the material on the tool 60 is minimized, thereby extending the working life of the tool 50.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A tool for producing a flow formed part comprising:

a main body having a first end and a second end, the first end adapted to abut a blank prepared from a flowable material; and an annular array of spline forming recesses formed intermediate the first end and the second end of the main body, each of the spline forming recesses including a first end edge formed at a first end thereof and a first rounded corner formed between the first end edge and a first side edge of each recess extending from the first end edge toward a second end of each of the recesses, each recess further including an outlet at the first end thereof, the outlet facilitating the flow of a portion of the flowable material therethrough during a flow forming process thereby producing a protuberant portion.

2. The tool of claim 1, wherein the outlet has a wedge shape.

3. The tool of claim 1, wherein the main body includes a stem extending therefrom adapted to be received by an aperture in the blank.

4. The tool of claim 1, wherein the flowable material is one of steel, a steel alloy, and aluminum.

5. The tool of claim 1, wherein the outlet of each of the recesses is formed between the first rounded corner and a second rounded corner formed between the first end edge and a second side edge of each of the recesses.

6. The tool of claim 1, wherein the blank is an annular ring.

7. The apparatus of claim 1, wherein the first rounded coiner is an interior corner formed between the first end edge and the first side edge of each recess.

8. The apparatus of claim 1, wherein the main body is cylindrical and the first rounded coiner curves around an axis extending radially outwardly from a central axis of the main body.

9. The apparatus of claim 1, wherein the first end edge, the first side edge, and the first rounded coiner each define at least a portion of a perimeter of each spline forming recess.

10. The apparatus of claim 1, wherein the main body is cylindrical and each of the first end edge and the first side edge is formed between an exterior circumferential surface of the main body and a surface forming each of the spline forming recesses.

11. The apparatus of claim 1, wherein the first rounded corner forms a portion of a peripheral edge extending around each of the spline forming recesses.

12. An apparatus for producing a flow formed part comprising:

a die having a main body including a first end, a second end, and an annular array of recesses intermediate the first end and the second end, each recess including a first end edge formed at a first end thereof and a first rounded corner formed between the first end edge and a first side edge of each recess extending from the first end edge toward a second end of each of the recesses, each recess also having an outlet formed at the first end thereof, the first end of the main body adapted to abut a blank formed of a flowable material, wherein the outlets facilitate the flow of a portion of the flowable material therethrough during a flow forming process; and a pressure plate adapted to receive a portion of the first end of the die, wherein the die is axially fixed to the pressure plate and the die and the blank are adapted to axially rotate with a portion of the pressure plate.

13. The apparatus of claim 12, wherein the outlet has a wedge shape.

14. The apparatus of claim 13, wherein the outlet has substantially rectangular cross-sectional shape.

15. The apparatus of claim 12, wherein the die includes a stem extending therefrom adapted to be received by an aperture in the blank and fixed to the pressure plate.

16. The apparatus of claim 12, wherein the flowable material is one of steel, a steel alloy, titanium, and aluminum.

17. The apparatus of claim 12, wherein the outlet of each of the recesses is formed between the first rounded corner and a second rounded corner formed between the first end edge and a second side edge of each recess.

* * * * *